US010332707B2

(12) United States Patent
Yamamoto et al.

(10) Patent No.: US 10,332,707 B2
(45) Date of Patent: Jun. 25, 2019

(54) ACTUATOR

(71) Applicant: DAICEL CORPORATION, Osaka (JP)

(72) Inventors: Yuzo Yamamoto, Hyogo (JP); Takatoshi Miyashita, Hyogo (JP)

(73) Assignee: Daicel Corporation, Osaka (JP)

( * ) Notice: Subject to any disclaimer, the term of this patent is extended or adjusted under 35 U.S.C. 154(b) by 0 days.

(21) Appl. No.: 15/638,170

(22) Filed: Jun. 29, 2017

(65) Prior Publication Data

US 2019/0006137 A1 Jan. 3, 2019

(51) Int. Cl.
*H01H 39/00* (2006.01)

(52) U.S. Cl.
CPC ..... *H01H 39/004* (2013.01); *H01H 39/006* (2013.01); *H01H 39/00* (2013.01)

(58) Field of Classification Search
CPC .... H01H 39/00; H01H 39/004–39/006; H01H 2039/008
USPC ..... 337/401
See application file for complete search history.

(56) References Cited

U.S. PATENT DOCUMENTS 4,111,221 A * 9/1978 Olsen ..... F15B 15/19 137/625.48
5,113,108 A * 5/1992 Yamashita ..... H01L 41/053 310/328
6,397,595 B2 6/2002 Benoit et al.
6,556,119 B1 * 4/2003 Lell ..... H01H 37/323 180/279
2004/0112239 A1 * 6/2004 Parks ..... B60N 2/231 102/202
2005/0034595 A1 * 2/2005 Kordel ..... B23D 15/145 89/1.14
2014/0061161 A1 3/2014 Nakamura et al.
2017/0314582 A1 * 11/2017 Lell ..... F15B 15/19
2017/0343021 A1 * 11/2017 Yamada ..... F42B 3/12

FOREIGN PATENT DOCUMENTS

JP 2014-049300 A 3/2014
WO WO 2016062304 A1 * 4/2016 ..... A61M 5/2046

OTHER PUBLICATIONS

EPO Machine Translation of Lell, WO 2016062304 A1.*

* cited by examiner

*Primary Examiner* — Jacob R Crum
(74) *Attorney, Agent, or Firm* — Knobbe Martens Olson & Bear LLP

(57) ABSTRACT

An actuator driven by combustion of powder satisfactorily transmits energy for driving an output part to the output part. An output piston part has a specific end face that receives driving energy. A sealing member confines the combustion products in a first space separated by the sealing member. The sealing member has a fixed end portion and a contact portion that is in contact with the specific end face. In a state before the combustion of powder in an igniter, the contact portion is located at an initial position. With the combustion of powder in the igniter, the contact portion shifts to an operative position with the sliding motion of the output piston part while being in contact with the specific end portion.

6 Claims, 6 Drawing Sheets

ACTUATOR

TECHNICAL FIELD

The present disclosure relates to an actuator that applies a specific force to a target object through an output piston part.

BACKGROUND ART

Some electrical circuits are provided with a circuit breaker that operates when an abnormality of a component device of the electrical circuit or an abnormality of a system including the electrical circuit occurs, to interrupt conduction between devices. As such a breaker, there has been developed a conduction breaker that drives a breaking member at high speed by high-pressure gas to forcibly and physically break a conductor existing between devices. For example, in the technology disclosed in Patent Literature 1, a breaking member is driven by high-pressure gas generated by a gas generator to break a conductor that constitutes a part of an electrical circuit and extinguish an arc generated between the broken ends of the conductor resulting from the breaking. This provides reliable conduction breaking.

There has also been developed an actuator for pressurization utilizing the energy of combustion of powder. For example, Patent Literature 2 discloses a technology pertaining to an actuator that drives a control member through a membrane utilizing the energy of combustion of powder to interrupt a flow of medium in a fluid channel. In this technology, an elastically deformable membrane sandwiched between the control member and a housing is deformed by the pressure of combustion of powder, and a cylinder part attached to the membrane shifts to drive the control member.

SUMMARY OF THE INVENTION

Problems to be Solved by the Invention

To efficiently use the energy of powder combustion as a power source of an actuator that applies a specific force to a target object, it is necessary to efficiently transmit the generated combustion energy to an output piston of the actuator. To achieve this, it is important to confine the combustion products generated by the combustion of powder in a certain closed space to increase the pressure in that space.

In the case where, as in the prior art, an elastically deformable membrane is used to separate the space in which the combustion of powder takes place and the space that accommodates an output part (or control member) of the actuator as the object to be pressurized and the energy of combustion of powder is transmitted to the control member by the deformation of the membrane, the membrane is elastically deformed abruptly upon the combustion. In order to shift the control member over a required distance, it is necessary for the membrane to be deformed greatly toward the control member by the combustion of powder. Then, there is a risk that the membrane may be broken or torn. If the membrane is broken, the combustion products cannot be confined in the space in which the combustion takes place, and it is difficult to drive the control member.

The present disclosure pertains to an actuator that is driven by powder combustion, and its object is to enable satisfactory transmission of energy to an output part to drive the output part.

Means for Solving the Problems

To solve the above problem, the present disclosure provides a structure in which a sealing member that separates the space in a main body of an actuator into an igniter side space and an output piston side space is adapted to confine combustion products produced by the igniter in the igniter side space. This structure can raise the pressure in the igniter side space appropriately. Moreover, a portion of the sealing member that is in contact with the output piston part is shifted from an initial position on the igniter side of a fixed end portion of the sealing member to an operative position on the output surface side of the fixed end portion by the combustion in the igniter. This configuration facilitates prevention of breakage of the sealing member while ensuring a satisfactorily large amount of shift of the output piston part, enabling satisfactory transmission of driving energy to the output piston part.

Specifically, according to the present disclosure, there is provided an actuator comprising an actuator main body including a through-bore extending along its axial direction and an output piston part disposed in such a way as to be capable of sliding in said through-bore and adapted to apply a specific force to a target object by causing said output piston part to protrude from an output surface of said actuator main body. The actuator further comprises an igniter that causes powder to burn and applies driving energy for causing said output piston part to slide to said output piston part by the combustion of powder in said igniter, and a sealing member that separates the space in said actuator main body into a first space in which said igniter is disposed and a second space in which said output piston part is disposed and confines combustion products produced by said igniter in said first space. Said output piston part has an operative end portion that acts on said target object and a specific end portion including a specific end face that receives said driving energy. Said sealing member has a fixed end portion fixed to an inner wall that defines the space in said actuator main body and a contact portion that is in contact with said specific end face of said specific end portion when the powder burns in said igniter. In a state before the combustion of powder in said igniter, said contact portion is located at an initial position on said igniter side of said fixed end portion. With the combustion of powder in said igniter, said contact portion shifts to an operative position on said output surface side of said fixed end portion with sliding motion of said output piston part while being in contact with said specific end face.

In the actuator according to the present disclosure, the space in the actuator main body is separated by the sealing member into the first space and the second space. This effectively leads to an increase in the pressure in the first space when the powder burns in the ignitor. Moreover, the contact portion of the sealing member is shifted from the initial position to the operative position by the driving energy generated by the combustion of powder in the igniter. During the process of this shift, the contact portion is in contact with the specific end face of the output piston part, so that the output piston part slides in the through-bore. With the sliding motion of the output piston part, the operative end portion of the output piston part protrudes from the output surface to apply a specific force to the target object. The specific force is set appropriately to achieve the aim of the application of the force to the target object. For example, to break a target object, the specific force is set to be a force required to break the target object. So long as the shift of the contact portion of the sealing member is caused by the combustion of powder, various structures may be employed, such as a structure in which the driving energy is directly applied to the output piston part through the contact portion or a structure in which the driving energy is firstly propagated to a gas, liquid, or solid and thereafter applied to the first piston part through the contact portion indirectly.

In the actuator according to the present disclosure, the igniter that causes powder to burn may be configured to ignite ignition charge accommodated in the igniter by an operation of the igniter thereby producing combustion products of the ignition charge or configured to induce further combustion of a known gas generating agent (e.g. a single base smokeless powder) by the ignition of the ignition charge thereby producing combustion products of the ignition charge and the gas generating agent. In the actuator according to the present disclosure, the structure of the igniter is not limited specifically.

As the powder burns in the igniter, the combustion products diffuse in the first space in the actuator main body, and the pressure in the first space rise to apply the driving energy to the output piston part. This energy serves as a power source for driving the output piston part, as described above. Since the actuator according to the present disclosure is provided with the sealing member, the combustion products are confined in the first space and do not enter the second space. Thus, the driving energy generated with the combustion products will not diffuse wastefully, but the driving energy is expected to be transmitted to the output piston part. To achieve the sealing effect, it is necessary that the sealing member have an appropriate degree of resistance against the combustion of powder. Moreover, it is undesirable that the provision of the sealing member interfere with the transmission of the driving energy to the output piston part. Therefore, it is necessary for the sealing member to achieve both the satisfactory confinement of the combustion products and the satisfactory transmission of the driving energy to the output piston part.

To achieve the above objects, the sealing member is configured in such a way that its contact portion shifts from the initial position on the igniter side of (in other words, closer to the igniter than) its fixed end portion fixed to the inner wall of the space in the actuator main body to the operative position on the output surface side of (in other words, closer to the output surface than) the fixed end portion while in contact with the specific end face of the output piston part. With this configuration, after the combustion of powder, the sealing member deforms in such a way that the contact portion is turned inside out in relation to the fixed end portion, thereby propelling the sliding motion of the output piston part. Therefore, the sealing member is not expanded only in one direction with the combustion of powder, unlike in the case of prior arts. Therefore, the possibility of breakage of the sealing member is reduced. Moreover, with the aforementioned inside-out turning deformation structure, the range of shift of the contact portion with the sliding motion of the output piston part extends from the initial position on the igniter side of the fixed end portion to the operative position on the output surface side of the fixed end portion. This eliminates a large deformation of the sealing member while ensuring a distance of shift of the contact portion large enough to enable the output piston part to slide over an adequate distance for application of the specific force to the target object. Therefore, the sealing member is unlikely to be broken. This enables both the satisfactory confinement of the combustion products and the satisfactory transmission of the driving energy to the output piston part.

In the actuator according to the present disclosure, the sealing member may be made of an elastic member. Then, the sealing member can expand with the combustion of powder in the igniter, enabling improved compatibility of the confinement of the combustion products and the transmission of the driving energy to the output piston part.

The sealing member may further have an intermediate portion that extends between said fixed end portion and said contact portion and covers a side surface of said specific end portion extending along the axial direction of said output piston part in the state before the combustion of powder in said igniter. Then, with the sliding motion of the output piston part resulting from the combustion of powder in said igniter, said contact portion shifts from said initial position to said operative position while said intermediate portion expands in said sliding direction. With this design of the actuator, the contact portion shifts with the intermediate portion of the sealing member expanding in the sliding direction of the output piston part, while propelling the output piston part. This provides an additional amount of sliding of the output piston part corresponding to the amount of expansion. In consequence, the driving energy generated by the combustion of powder is used preferably in propelling the output piston part, enabling the output piston part to slide over an adequate distance. Moreover, as the intermediate portion that expands in the sliding direction of the output piston part is made of an elastic member, the intermediate portion can expand elastically. Therefore, the sealing member is unlikely to break.

In the above described actuator, an outer diameter of said specific end portion of said output piston part may be smaller than an inner diameter of said through-bore. Then, said intermediate portion expands in said sliding direction along the inner wall of said through-bore with the sliding motion of the output piston part resulting from the combustion of powder in said igniter. With this feature, the output piston part leaves a gap in the radial direction of the through-bore in the region near the specific end portion. When the contact portion moves with the combustion of powder, the intermediate portion can expand utilizing this gap, enabling smooth expansion of the intermediate portion. Therefore, the output piston part can slide over an adequate distance, and breakage of the sealing member can be prevented.

The above-described actuator may further comprise an auxiliary piston part arranged in said first space in such a way as to be capable of sliding in said through-bore and to sandwich said contact portion of said sealing member with said specific end face of said output piston part. Said auxiliary piston part has an igniter side end portion opposed to said igniter to which said driving energy is input and an output piston side end portion that transmits said driving energy to said specific end face of said output piston part through said contact portion.

With this configuration of the actuator, the auxiliary piston part receives the driving energy from the igniter by its igniter side end portion and transmits the driving energy to the specific end face of the output piston part by its other end or the output piston side end portion through the contact portion of the sealing member sandwiched between the output piston part and the auxiliary piston part. Thus, the sealing member does not receive the driving energy directly from the igniter but through the auxiliary piston part. Therefore, the contact portion is not exposed directly to high-temperature, high-pressure combustion products during the combustion of powder, and breakage of the sealing member including the contact portion can be prevented with improved reliability. Moreover, since the contact portion is sandwiched between the output piston part and the auxiliary piston part, a force for turning the sealing member inside out can be applied to the sealing member appropriately, enabling smooth sliding of the output piston part.

The present disclosure enables satisfactory transmission of energy to an output part to drive the output part in an actuator that is driven by powder combustion.

EMBODIMENTS FOR CARRYING OUT THE INVENTION

In the following, embodiments of an actuator according to the present disclosure will be described with reference to the accompanying drawings. It is to be understood that features of the embodiments will be described for illustrative purposes, and the present disclosure is not limited by the described features of the embodiments.

First Embodiment

Figure 1:
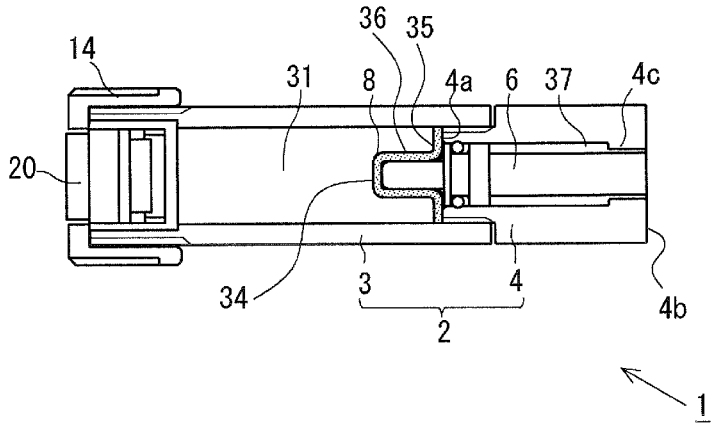
FIG. 1 is a diagram showing the general configuration of an actuator according to a first embodiment of the present disclosure.

FIG. 1 is a cross sectional view of an actuator 1 taken along its axial direction. The actuator 1 includes an actuator main body 2 made up of a first housing 3 and a second housing 4. The front end of the actuator main body 2 (i.e. the end of the second housing 4 opposite to the end connected to the first housing 3) is the output side of the actuator 1, that is, the side on which a target object to which a specific force is to be applied. The first housing and the second housing 4 are fastened together by a screw. Inside the first housing 3, a combustion chamber 31 is formed. The combustion chamber 31 is the interior space extending in the axial direction of the first housing 3. Inside the second housing 4, a through-bore 37 is formed. The through-bore 37 is an interior space extending along the axial direction of the second housing 4. The combustion chamber 31 and the through-bore 37 are continuously arranged spaces inside the actuator main body 2, which are separated by a sealing member 8 that will be described later.

The front end face of the actuator main body 2 (namely the front end face of the second housing 4) constitutes an output surface 4*b*. The output surface 4*b* is a surface opposed to a target object to which a specific force is to be applied. A metal output piston 6 is provided in the through-bore 37 inside the second housing 4 of the actuator main body 2. The output piston 6 is held in the through-bore 37 in such a way as to be capable of sliding in the through-bore 37.

Figure 2:
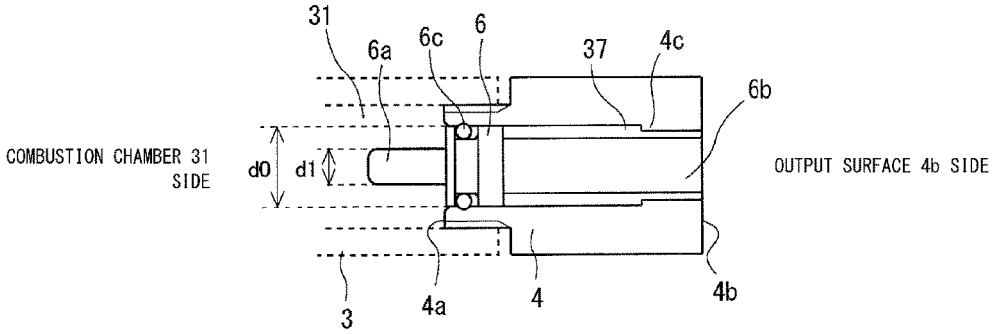
FIG. 2 is a diagram specifically showing a piston of the actuator shown in FIG. 1.

FIG. 2 shows the details of the output piston 6 to facilitate the understanding of its positional relationship with the second housing 4. The output piston 6 has a generally shaft-like shape extending along the axial direction of the through-bore 37. The output piston 6 has a first end portion 6*a* on the combustion chamber 31 side and a second end portion 6*b* on the output surface 4*b* side, which applies a specific force on a target object. O-rings 6*c* are provided around the output piston 6 so as to allow the output piston 6 to slide smoothly in the through-bore 37.

Figure 5:
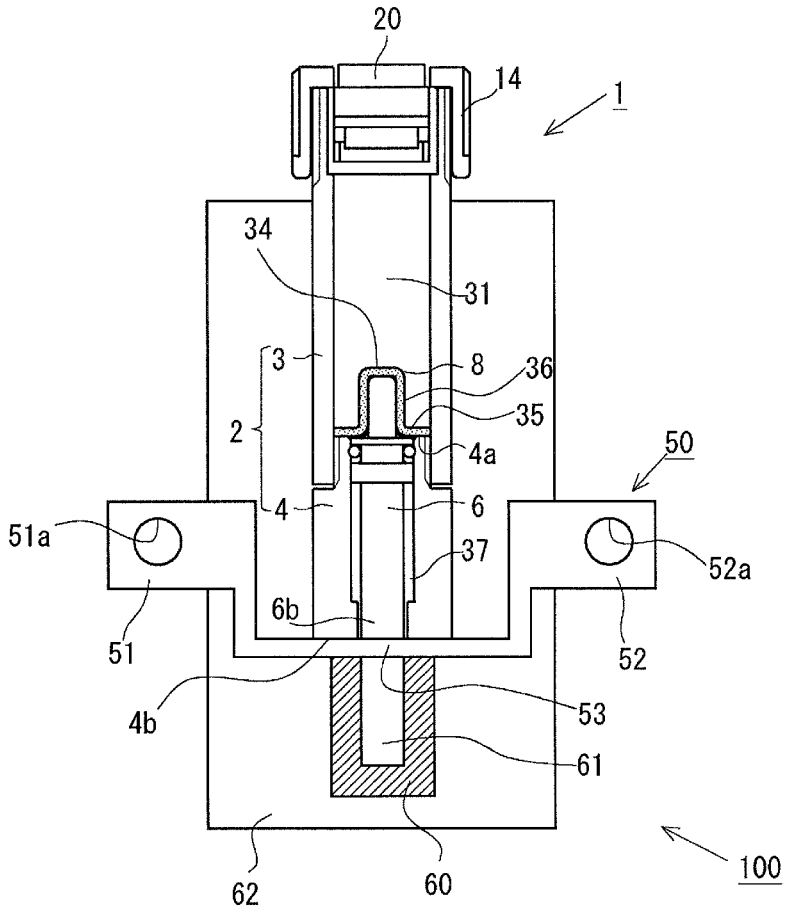
FIG. 5 is a diagram showing the general configuration of an electrical circuit breaker to which the actuator according to the first embodiment of the present disclosure is applied.

In the state in which the first housing 3 (shown by broken lines in FIG. 2) and the second housing 4 are attached together to constitute the actuator main body 2 before the combustion of powder in an initiator 20 serving as an igniter (which will be described later), the first end portion 6*a* substantially projects into the combustion chamber 31 of the first housing 3 beyond the end face of the fitted portion 4*a* of the second housing 4 that is fitted into the combustion chamber 31. The aforementioned state will be hereinafter referred to as the "pre-combustion state". The diameter dl of the first end portion 6*a* is smaller than the diameter d0 of the through-bore 37. Hence, when the output piston 6 slides in the through-bore 37 toward the output surface 4*b*, a gap is left between the side surface of the first end portion 6*a* (i.e. the surface of the output piston 6 that extends along its axial direction) and the inner surface of the through-bore 37. In the pre-combustion state, the end face of the second end portion 6*b* is either coplanar with the output surface 4*b* or recessed from the output surface 4*b* into the through-bore 37. When the actuator 1 is used, the actuator 1 is arranged in such a way that the output surface 4*b* is in contact with the target object to which a specific force is to be applied, as shown in FIG. 5 that will be described later, and fixed at that position.

In the pre-combustion state shown in FIG. 1, the sealing member 8 is attached to the end face of the fitted portion 4*a* of the second housing 4, which is a part of the inner wall of the actuator main body 2. Thus, the sealing member 8 made of an elastic material divides the space inside the actuator main body 2 into a space including the combustion chamber 31 on the initiator 20 side (corresponding to the first space according to the present disclosure) and a space including the through-bore 37 on the output piston 6 side (corresponding to the second space according to the present disclosure) so as to confine the combustion products produced by the combustion of powder in the initiator 20 in the combustion chamber 31. The details of the structure of the sealing member 8 and its operation upon the combustion of powder in the initiator 20 will be described later.

Figure 3:
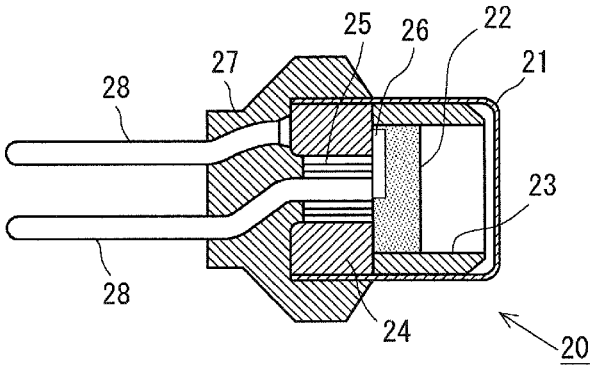
FIG. 3 is a diagram showing the basic structure of an initiator (or igniter) attached to the actuator shown in FIG. 1.

Now, an exemplary structure of the initiator 20 will be described with reference to FIG. 3. The initiator 20 is an electric igniter. The initiator 20 has a cup 21, the surface of which is covered with an insulating cover. A space in which ignition charge 22 is set is defined inside the cup 21. In this space, a metal header 24 is also provided. An annular charge holder 23 is set on the top of the metal header 24. The charge holder 23 holds the ignition charge 22. On the bottom of the ignition charge is arranged a bridge wire 26, which electrically connects one of two conducting pins 28 and the metal header 24. The two conducting pins 28 are fixed to the metal header 24 by an insulator 25 so that the two conducting pins 28 will be isolated from each other when a voltage is not applied. The opening of the cup 21 from which the two conducting pins 28 supported by the insulator 25 extend out is protected by a resin collar 27 with excellent isolation of the conducting pins 28 from each other.

With the above-described structure of the initiator 20, when a voltage is applied between the two conducting pins 28 by an external power source, a current flows through the bridge wire 26 to burn the ignition charge 22. Then, the combustion products produced by the combustion of the ignition charge 22 spout from the opening of the charge holder 23. An initiator cap 14 is formed to have a brim-shaped cross section so that the initiator cap 14 is caught or hooked by the outer surface of the initiator 20, and the initiator cap 14 is screw-fixed to the first housing 3. Thus, the initiator 20 is fixed to the first housing 3 by the initiator cap 14, and the initiator 20 is prevented from being disengaged from the actuator main body 2 due to the pressure generated upon ignition by the initiator 20.

Note that the ignition charge 22 used in the actuator is preferably exemplified by a powder containing zirconium and potassium perchlorate (ZPP), a powder containing titanium hydride and potassium perchlorate (THPP), a powder containing titanium and potassium perchlorate (TiPP), a powder containing aluminum and potassium perchlorate (APP), a powder containing aluminum and bismuth oxide (ABO), a powder containing aluminum and molybdenum trioxide (AMO), a powder containing aluminum and copper oxide (ACO), a powder containing aluminum and ferric oxide (AFO), and a mixture of some of the aforementioned powders. Properties of these powders are that they generate a high-temperature, high-pressure plasma in the combustion immediately after the ignition, but the pressure drops quickly when the temperature drops to room temperature and the combustion products condense, because of the absence of gas components. Powders other than the aforementioned powders may also be used as the ignition charge.

In the case shown in FIG. 1, the combustion chamber 31 is empty. However, a gas generating agent that is combusted by combustion products produced by the combustion of the ignition charge 22 to generate a gas may be provided in the combustion chamber 31. In the case where a gas generating agent is provided in the combustion chamber 31, it may be, for example, a single base smokeless powder including 98% by mass of nitrocellulose, 0.8% by mass of diphenylamine, 1.2% by mass of potassium sulfate. Alternatively, gas generating agents used in gas generators for airbags or seat belt pretensioners may be employed. In the case where such a gas generating agent is additionally employed, the drop rate of the generated pressure is lower, because gases generated by the combustion contain gas components even at room temperature unlike in the case where only the ignition charge 22 is employed. The combustion completion time, which is much longer than that of the ignition charge 22, can be varied by adjusting the dimensions, size, and shape, in particular surface shape of the gas generating agent provided in the combustion chamber 31. Thus, the pressure generated in the combustion chamber 31 can be adjusted appropriately by adjusting the amount, shape, and arrangement of the gas generating agent.

Now, the sealing member 8 in the pre-combustion state will be specifically described. As shown in FIG. 1, the sealing member 8 is configured to cover the first end portion 6*a* of the output piston 6 projecting into the combustion chamber 31. More specifically, the sealing member 8 includes a fixed end portion 35 that is attached to the fitted portion 4*a* of the second housing 4, a contact portion 34 that is in contact with the end face of the first end portion 6*a* and arranged to cover the end face, and an intermediate portion 36 that extends between the contact portion 34 and the fixed end portion 35 to cover the side surface of the first end portion 6*a*. Thus, in the cross section along the axial direction of the actuator 1 shown in FIG. 1, the sealing member 8 has a U-shape, and the contact portion 34 constituting the "bottom" of the U-shape is located at its initial position that is closer to the initiator 20 than (or on the left of, in FIG. 1) the fixed end portion 35.

Figure 4:
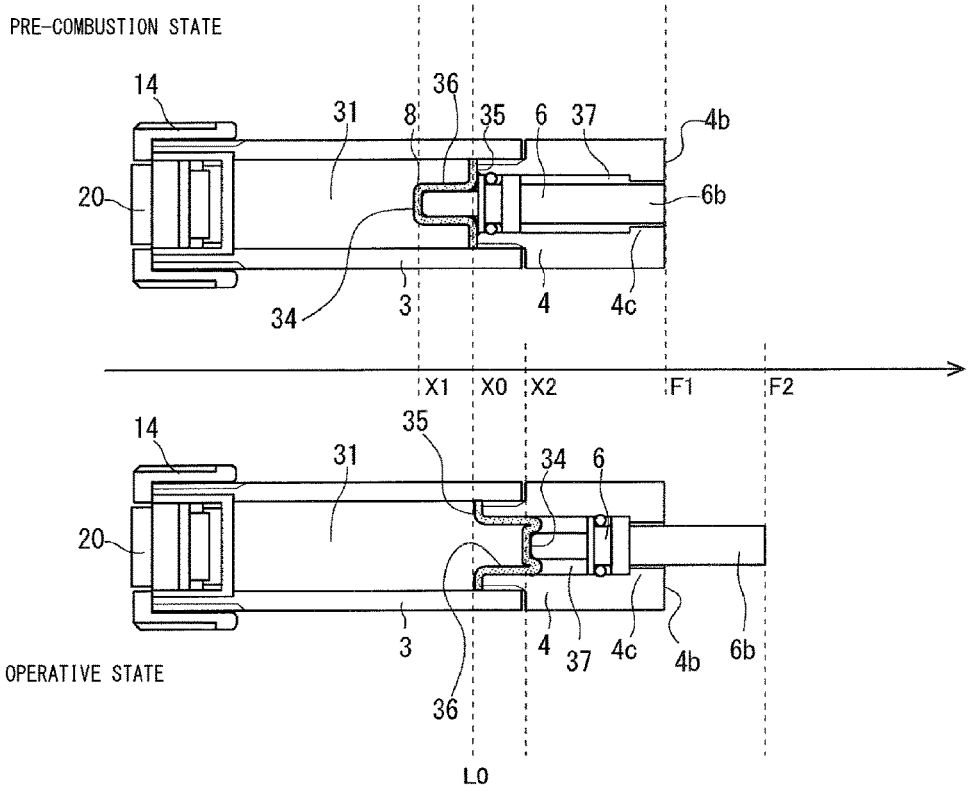
FIG. 4 is a diagram showing the actuator shown in FIG. 1 in a state before the combustion of powder in the initiator and a state after the combustion of powder in the initiator in comparison.

Next, the action of the sealing member 8 and the operation of the actuator 1 upon the combustion of the ignition charge 22 in the initiator 20 will be described with reference to FIG. 4. The upper diagram in FIG. 4 shows the configuration of the actuator 1 in the pre-combustion state, and the lower diagram in FIG. 4 shows the actuator 1 in the state in which the actuator 1 is caused to operate by the combustion of the ignition charge 22. The latter state will be hereinafter referred to as the "operative state". In FIG. 4, the positions of the fixed end portion 35 of the sealing member 8 in the diagrams showing the pre-combustion state and the operative state are aligned with respect to the axial direction of the actuator 1 for comparison of the two states. The position of the fixed end portion 35 that is common between the two states is indicated as position X0, and a fiducial line at position X0 is indicated as line L0.

The position of the contact portion 34 in the pre-combustion state is indicated by X1, which is on the initiator 10 side of (in other words, closer to the initiator 20 than) position X0, as described above. The position of the end face of the second end portion 6*b* of the output piston 6 in this state is indicated by F1. As the ignition charge 22 burns, combustion products diffuse in the combustion chamber 31, so that the pressure in the combustion chamber 31 rises. Consequently, the pressure is exerted on the sealing member 8 also. In particular, the pressure that pushes the output piston 6 in the direction toward the output surface 4*b* is the pressure that acts on the output piston 6 through the contact portion 34 of the sealing member 8. Therefore, the end face of the first end portion 6*a* of the output piston 6 in contact with the contact portion 34 is the surface that receives the driving energy from the initiator 20.

As above, the contact portion 34 of the sealing member 8 is a portion that transmits the driving energy generated by the combustion of the ignition charge 22 to the output piston 6. Thus, as the contact portion 34 of the sealing member 8 moves toward the output surface 4*b*, the output piston 6 slides in the through-bore 37. Consequently, the second end portion 6*b* of the output piston 6 projects beyond the output surface 4*b* by an amount that depends on the amount of sliding shift of the output piston 6. Thus, the output piston 6 can exert a specific force on a target object set on or near the output surface 4*b*. In the operative state in which the sliding of the output piston 6 has been completed, a part of the output piston 6 abuts a stopper portion 4*c* of the second housing 4, which defines the narrowed-down portion of the through-bore 37 near the output surface 4*b*, preventing the output piston 6 from going out of the through-bore 37. The position of the contact portion 34 in this state will be referred to as the operative position, which is indicated by X2. This position X2 is on the output surface 4*b* side of the position X0. The position of the end face of the second end portion 6*b* is indicated by F2.

In the actuator 1 as above, during the combustion of the ignition charge 22, the contact portion 34 of the sealing member 8 shifts from the initial position X1 assumed in the pre-combustion state to the operative position X2 assumed in the operative state. The distance (X2-X1) of this shift of the contact portion 34 is equal to the distance (F2-F1) of shift of the output piston 6 for application of a specific force. With this shift, the sealing member 8 deforms in such a way as to be turned inside out. The shift distance of the output piston 6 that is needed to apply a specific force is achieved by this inside-out turning deformation of the sealing member 8. In this inside-out turning deformation of the sealing member 8, it is not necessary for the sealing member 8 to elastically deform greatly, but this inside-out turning deformation is basically achieved only by a shift of the intermediate portion 36 and the contact portion 34 of the sealing member 8 with the fixed end portion 35 being fixed. Even in cases where the contact portion 34 shifts greatly toward the output surface 4*b* due to the driving energy generated by the combustion of the ignition charge 22 to cause the intermediate portion 36 to expand, the intermediate portion 36 firstly shifts from the state shown in the upper drawing in FIG. 4 toward the output surface 4*b* and thereafter expands with the shift of the contact portion 34. Therefore, the amount of elastic deformation of the intermediate portion 36 can be kept small. Therefore, breakage of the sealing member 8 can be prevented while ensuring a sufficient distance of shift of the output piston 6 for application of a specific force. Thus, the driving energy generated by the combustion can be transmitted to the output piston 6 satisfactorily, so that the actuator 1 can operate efficiently.

As described above, the diameter dl of the first end portion 6*a* of the output piston 6 is smaller than the inner diameter d0 of the through-bore 37. Therefore, as the aforementioned inside-out turning deformation of the sealing member 8 progresses, the intermediate portion 36 partly gets into the gap between the first end portion 6*a* and the wall of the through-bore 37, so that the inside-out turning deformation and expansion of the intermediate portion 36 can progress smoothly along the inner wall of the through-bore 37. When at the operative position, the contact portion 34 is not necessarily in contact with the end face of the first end portion 6*a* of the output piston 6.

(Application)

FIG. 5 shows an electrical circuit breaker 100 as an application of the actuator 1. In the electrical circuit breaker 100, the actuator 1 is fixed to a conductor piece 50 by means of a housing 62.

When the electrical circuit breaker 100 is set to an electrical circuit, the conductor piece 50 constitutes a part of the electrical circuit. The conductor piece 50 is composed of a first connector part 51 and a second connector part 52 on both ends and a cut part 53 extending between the connector parts 51, 52. Each of the first and second connector parts 51, 52 has a connection hole 51*a*, 52*a* for connection with another conductor (e.g. lead wire) in the electrical circuit. While in the illustrative conductor piece 50 shown in FIG. 5, the first contact part 51, the second contact part 52, and the cut part 53 form a stepped shape, the first contact part 51, the second contact part 52, and the cut part 53 may be generally straight alternatively. The cut part 53 is fixed in such a way as to be in contact with the output surface 4*b* of the actuator 1. Thus, the end face of the output piston 6 (or the end face of the second end portion 6*b*) in the actuator 1 is opposed to the cut part 53. The conductor piece 50 arranged in this way constitutes the target object mentioned in the embodiment. In particular, the cut part 53 is a part of the target object to which a specific force is to be applied by the actuator 1.

In the housing 62, a box-like insulation part 60 made of a plastic is provided at a position opposed to the actuator 1 with the cut part 53 between. The insulation part has an insulation space 61 inside it.

In the electrical circuit breaker 100 configured as above, when the initiator 20 is started to operate in response to a certain trigger signal or a manual entry, the output piston 6 slides as described above to apply a shearing force to the cut part 53 by its kinetic energy, so that the cut part 53 is cut. In consequence, the conduction between the first connector part 51 and the second connector part 52 of the conductor piece 50, which constitutes a part of the electrical circuit equipped with the electrical circuit breaker 100, is interrupted. The cut pieces of the cut part 5 cut by the output piston 6 are received in the insulation space 61 in the insulation part 60. This can improve the reliability of the aforementioned interruption of conduction.

As above, in the electrical circuit breaker 100 that employs the actuator 1 according to the present disclosure, the actuator 1 can operate efficiently. This is greatly advantageous for the electrical circuit breaker 100, which is required to achieve interruption of conduction with reliability when necessary. Other examples of the application of the actuator 1 include a piercing machine that makes a hole on a target object.

Second Embodiment

Figure 6:
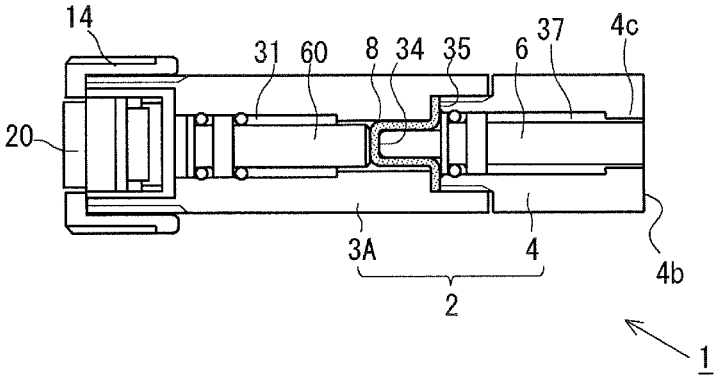
FIG. 6 is a diagram showing the general configuration of an actuator according to a second embodiment of the present disclosure.

FIG. 6 shows an actuator 1 according to a second embodiment of the present disclosure. In the above-described first embodiment, the driving energy generated by the initiator 20 is transmitted to the output piston 6 through the sealing member 8, and the sealing member 8 is directly exposed to the combustion gases. In the second embodiment, the driving energy is firstly transmitted to an auxiliary piston 60, and then indirectly transmitted to an output piston 6 through a sealing member 8. Thus, the sealing member 8 is prevented from being exposed directly to combustion products. In this second embodiment, an actuator main body 2 is made up of a first housing 3A and a second housing 4. In the following description, components in the second embodiment that are substantially the same as those in the first embodiment will be denoted by the same reference numerals and will not be described in further detail.

The first housing 3A has a combustion chamber 31 formed inside. The combustion chamber 31 is configured in such a way that combustion products produced by the initiator 20 diffuse in it. An auxiliary piston 60 made of metal is provided in the combustion chamber 31. The auxiliary piston 60 is held in such a way as to be capable of sliding in the combustion chamber 31. One end of the auxiliary piston 60 is opposed to the initiator 20, and the other end is arranged to sandwich the contact portion 34 of the sealing member 8 with the first end portion 6*a* of the output piston 6. When the ignition charge 22 is burned by the operation of the initiator 20, the driving energy is input to the end of the auxiliary piston 60 opposed to the initiator 20, and then transmitted to the output piston 6 through the contact portion 34 of the sealing member 8. Thus, when the ignition charge 22 burns, the output piston 6 slides along with the auxiliary piston 60. In this case also, the sealing member 8 undergoes an inside-out turning deformation like in the above-described first embodiment. In this second embodiment, since the contact portion 34 is sandwiched between the auxiliary piston 60 and the output piston 6, the deformation of the sealing member 8 is restricted to a specific direction, enabling the inside-out turning deformation to progress smoothly. In this embodiment, since the driving energy is firstly input to the auxiliary piston 60, the sealing member 8 is prevented from being exposed directly to the combustion products. This reduces the thermal stress on the sealing member 8, enabling improved prevention of its breakage.

As above, the actuator 1 according to the second embodiment can also be applied to the electric circuit breaker shown in FIG. 5.

Example 1

We conducted an experiment to examine whether sealing is achieved by the sealing member 8 when powder is burned in the initiator 20 in the actuator 1 according to the above-described first embodiment. The rubber material used as the sealing member 8 was NBR (nitrile-butadiene rubber). The examination was carried out using rubber materials having different hardness (or durometers) at different temperatures of the actuator 1 at the time of operation, and breakage or the like of the sealing member 8 was checked visually.

More specifically, the examination was carried out using two rubber materials having durometers of 50 and 70 at three different temperatures of the actuator 1, specifically high temperature (50° C.), normal temperature (20° C.), and low temperature (0° C.). The peak pressure in the combustion chamber 31 during the combustion of powder was 30 MPa, and the thickness of the sealing member 8 was 1 mm. For each hardness and temperature, the combustion of powder in the initiator 20 was performed three times, and breakage of the sealing member 8 was checked, but no breakage was found in all the conditions.

Example 2

We conducted an experiment to examine whether sealing is achieved by the sealing member 8 when powder is burned in the initiator 20 in the actuator 1 according to the above-described second embodiment. The rubber materials used as the sealing member 8 were chloroprene and NBR. The examination was carried out at different temperatures of the actuator 1 at the time of operation, and breakage or the like of the sealing member 8 was checked visually.

More specifically, the examination was carried out using a chloroprene having a durometer of 65 and an NBR having a durometer of 70 as rubber materials at three different temperatures of the actuator 1, specifically high temperature (50° C.), normal temperature (20° C.), and low temperature (0° C.). The peak pressure in the combustion chamber during the combustion of powder was 30 MPa, and the thickness of the sealing member 8 was 1 mm. For each rubber material and temperature, the combustion of powder in the initiator 20 was performed three times, and breakage of the sealing member 8 was checked, but no breakage was found in all the conditions.

It will be understood from the above examples that NBR can be preferably used as the rubber material of the sealing member 8 in both the embodiments. In the second embodiment, chloroprene can also be used as the material of the sealing member 8. The above examples are given merely by way of example. Chloroprene can be used as the rubber material of the sealing member in the first embodiment also with appropriate adjustment of the hardness thereof and appropriate limitation of the temperature condition of the actuator 1.

The invention claimed is:

1. An actuator comprising an actuator main body including a through-bore extending along its axial direction and an output piston part configured to slide in said through-bore so as to apply a specific force to a target object by causing said output piston part to slide a shift distance and protrude from an output surface of said actuator main body, comprising:

an igniter that causes powder to burn and applies driving energy for causing said output piston part to slide in said through-bore by the combustion of powder in said igniter; and a sealing member that separates the space in said actuator main body into a first space in which said igniter is disposed and a second space in which said output piston part is disposed and confines combustion products produced by said igniter in said first space, wherein said output piston part has an operative end portion that acts on said target object and a specific end portion including a specific end face that receives said driving energy, said sealing member has a fixed end portion fixed to an inner wall that defines the space in said actuator main body and a contact portion that is in contact with said specific end face of said specific end portion when the powder burns in said igniter, in a state before the combustion of powder in said igniter, said contact portion is located at an initial position on an igniter side of said fixed end portion, and with the combustion of powder in said igniter, said contact portion shifts to an operative position on an output surface side of said fixed end portion with sliding motion of said output piston part while being in contact with said specific end face, wherein the sealing member is configured to deform in such a way as to be turned inside out so that the shift distance of said output piston part is achieved when said contact portion shifts from said initial position to said operative position, and wherein a portion of the sealing member maintains a concave shape facing said output piston part when the sealing member is turned inside out in the operative position.

2. An actuator according to claim 1, wherein said sealing member is made of an elastic material.

3. An actuator according to claim 2, wherein said sealing member further has an intermediate portion that extends between said fixed end portion and said contact portion and covers a side surface of said specific end portion extending along the axial direction in the state before the combustion of powder in said igniter, and with the sliding motion of the output piston part resulting from the combustion of powder in said igniter, said contact portion shifts from said initial position to said operative position while said intermediate portion expands in said sliding direction.

4. An actuator according to claim 3, wherein an outer diameter of said specific end portion of said output piston part is smaller than an inner diameter of said through-bore, and said intermediate portion expands in said sliding direction along the inner wall of said through-bore with the sliding motion of the output piston part resulting from the combustion of powder in said igniter.

5. An actuator according to claim 1, further comprising an auxiliary piston part arranged in said first space in such a way as to be capable of sliding in said through-bore and to sandwich said contact portion of said sealing member with said specific end face of said output piston part, said auxiliary piston part including an igniter side end portion opposed to said igniter to which said driving energy is input and an output piston side end portion that transmits said driving energy to said specific end face of said output piston part through said contact portion.

6. An actuator comprising:

an actuator main body including a through-bore extending along its axial direction;

an output piston part configured to slide in said through-bore and apply a specific force to a target object by causing said output piston part to protrude from an output surface of said actuator main body;

an igniter that causes powder to burn and applies driving energy for causing said output piston part to slide by the combustion of powder in said igniter; and a sealing member that separates the space in said actuator main body into a first space in which said igniter is disposed and a second space in which said output piston part is disposed and confines combustion products produced by said igniter in said first space, wherein said output piston part has an operative end portion that acts on said target object and a specific end portion, said specific end portion including a specific end face and a side surface, said specific end face being configured to receive said driving energy, said sealing member has a fixed end portion fixed to an inner wall that defines the space in said actuator main body, a contact portion that is in contact with said specific end face of said specific end portion when the powder burns in said igniter, and an intermediate portion that extends between said contact portion and said fixed end portion, in a state before the combustion of powder in said igniter, said contact portion is located at an initial position on an igniter side of said fixed end portion and said intermediate portion covers said side surface of said specific end portion, and with the combustion of powder in said igniter, said contact portion shifts to an operative position on an output surface side of said fixed end portion with sliding motion of said output piston part while being in contact with said specific end face, wherein said intermediate portion covers at least a portion of said side surface when in said operative position.

* * * * *